US011826922B2

(12) United States Patent
De Vries et al.

(10) Patent No.: US 11,826,922 B2
(45) Date of Patent: Nov. 28, 2023

(54) COUPLING ASSEMBLY FOR USE IN A PERSONAL CARE APPLIANCE

(71) Applicant: KONINKLIJKE PHILIPS N.V., Eindhoven (NL)

(72) Inventors: Alwin William De Vries, Zuidlaren (NL); Marc Alexander Pastoors, Gieten (NL); Marcus Cornelis Petrelli, Groningen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 17/299,074

(22) PCT Filed: Jul. 13, 2020

(86) PCT No.: PCT/EP2020/069741
§ 371 (c)(1),
(2) Date: Jun. 2, 2021

(87) PCT Pub. No.: WO2021/013608
PCT Pub. Date: Jan. 28, 2021

(65) Prior Publication Data

US 2022/0143851 A1 May 12, 2022

(30) Foreign Application Priority Data

Jul. 24, 2019 (EP) ..... 19188142

(51) Int. Cl.
*B26B 19/38* (2006.01)
*B26B 19/04* (2006.01)
*B26B 19/14* (2006.01)

(52) U.S. Cl.
CPC ..... *B26B 19/386* (2013.01); *B26B 19/3813* (2013.01); *B26B 19/14* (2013.01)

(58) Field of Classification Search
CPC .... B26B 19/386; B26B 19/3813; B26B 19/14
See application file for complete search history.

(56) References Cited

U.S. PATENT DOCUMENTS

2005/0123346 A1* 6/2005 Nakamura ..... F16B 7/0406 403/348
2016/0101529 A1* 4/2016 Wind ..... B26B 19/3813 30/43.4

FOREIGN PATENT DOCUMENTS

EP 1484545 A1 * 12/2004 ..... F16L 37/248
EP 2086729 B1 5/2012
(Continued)

OTHER PUBLICATIONS

International Search Report and Written Opinion dated Sep. 17, 2020 for International Application No. PCT/EP2020/069741 Filed Jul. 13, 2020.

*Primary Examiner* — Nhat Chieu Q Do

(57) ABSTRACT

A coupling assembly is provided which includes a coupling element and a retaining member. One of the coupling element and the retaining member includes at least one cam element and another of the coupling element and the retaining member includes at least one notch. Both the cam element and the notch have two oppositely sloped surfaces. In a coupled position of the coupling assembly, the cam element and the notch only contact each other at two sides through the sloped surfaces at the position of a contact portion at a base of the cam element and an associated contact portion of the notch at an open side of the notch.

20 Claims, 5 Drawing Sheets

(56) References Cited

FOREIGN PATENT DOCUMENTS

| | | | | |
|---|---|---|---|---|
| EP | 2564680 | A1 * | 3/2013 | ..... A01B 71/06 |
| WO | 2014/191265 | A1 | 12/2014 | |
| WO | 2017/207437 | A1 | 12/2017 | |

* cited by examiner

COUPLING ASSEMBLY FOR USE IN A PERSONAL CARE APPLIANCE

CROSS REFERENCE TO RELATED APPLICATIONS

This application is the U.S. National Phase application under 35 U.S.C. § 371 of International Application No. PCT/EP2020/069741 filed Jul. 13, 2020, which claims the benefit of European Patent Application Number 19188142.4 filed Jul. 24, 2019. These applications are hereby incorporated by reference herein.

FIELD OF THE INVENTION

The invention relates to a coupling assembly configured to be used in a personal care appliance at an interface between a body and a head of the personal care appliance for releasably coupling the body and the head, wherein the coupling assembly comprises a coupling element and a retaining member having a receiving space which is configured to receive and accommodate the coupling element, wherein one of the coupling element and the retaining member comprises at least one cam element projecting in a direction of a central axis of the coupling assembly and another of the coupling element and the retaining member comprises at least one notch which is configured to receive and accommodate the at least one cam element so as to constitute at least one coupling combination, and wherein, in a peripheral direction about the central axis, the at least one cam element has two oppositely sloped surfaces converging in a direction from a base to a furthest projecting end of the at least one cam element, and the at least one notch has two oppositely sloped surfaces converging in a direction from an open side to a deepest side of the at least one notch so as to allow release of a coupled position of the coupling assembly on the basis of a rotation of the coupling element and the retaining member with respect to each other about the central axis.

Further, the invention relates to a personal care appliance such as a shaving appliance, comprising a body, a head and a coupling assembly as mentioned, wherein the coupling assembly is located at an interface between the body and the head for releasably coupling the body and the head.

BACKGROUND OF THE INVENTION

EP 2086729 A1 relates to a shaving appliance comprising a base structure and a head structure, wherein the head structure comprises a head support structure configured to support at least two rotary shaving heads, and wherein the base structure is free of support elements in an area of an outer periphery of the head structure such that the head structure, when coupled to the base structure, is not supported in the area of its outer periphery.

The head structure comprises a coupling element, and the base structure comprises a retaining structure configured for releasably retaining the coupling element for coupling the head structure to the base structure, wherein the head structure, when coupled to the base structure, is substantially only retained on the base structure by a retaining force exerted by the retaining structure on the coupling element. The coupling element is a shaft-like element protruding from a central area of the head structure and comprising at its distal end a sloped surface facing the head support structure. The retaining structure comprises a retaining recess for receiving the coupling element, and a spring element at least partly provided in the retaining recess. In particular, the spring element is arranged for engaging the sloped surface of the coupling element such that the coupling element is retainable in the retaining recess.

When an external load is exerted on the head structure of the shaving appliance, the load is transferred to the coupling element. Since in the coupled state the head structure is not supported in the area of its outer periphery, the area of the outer periphery cannot contribute to transferring the external load to the base structure. As a result, the coupling element has to transfer a substantial part of the external load. Since in addition the coupling element is arranged in the central area of the head structure, the mechanical torque associated with the external load will lead to a relatively high force on the coupling element. If the external load is large enough, the coupling element is released from the retaining structure, thereby preventing that an overload would result in damage to the shaving head or the head structure. Hence, in normal use of the shaving appliance, the coupling element and the retaining structure provide a solid coupling between the head structure and the base structure such that a force exerted on the shaving appliance during normal use does not result in release of the coupling element. Only if the load exceeds a critical value, for example due to an accidental misuse or fall, the coupling element is released from the base structure.

WO 2014/191265 A1 relates to a personal care appliance like a shaving appliance, comprising a base structure and a head structure, wherein the head structure comprises a first coupling element and at least a head support structure configured to hold at least one treatment head, and wherein the base structure comprises a second coupling element. The coupling elements can releasably be coupled to each other for coupling the head structure to the base structure. By rotating the coupled coupling elements with respect to each other in a first rotational direction about a central axis, a first inclined surface of at least one of the first and second coupling elements cooperates with a first co-operating surface of the other of the first and second coupling elements, thereby driving the first and second coupling elements away from each other in an axial direction extending parallel to the central axis. Also, by rotating the coupled coupling elements with respect to each other in a second rotational direction about the central axis, opposite to the first rotational direction, a second inclined surface of at least one of the first and second coupling elements cooperates with a second co-operating surface of the other of the first and second coupling elements, thereby driving the first and second coupling elements away from each other in the axial direction. Further, the first and second inclined surfaces each include an obtuse angle with a tangential direction extending tangentially to the central axis, wherein the first and second inclined surfaces are inclined in opposite directions relative to the tangential direction.

When rotating the coupling elements about the central axis, the first and second inclined surfaces will at least be moved in the tangential direction, and, depending on the rotational direction, one of the first and second inclined surfaces will slide over the respective one of the first and second co-operating surfaces in the axial direction. Due to the use of the first and second inclined surfaces, the coupling elements will easily be driven away from each other in the axial direction, whereby the coupling between the coupling elements will be released. Since there are at least two inclined surfaces on preferably each coupling element inclined in opposite direction relative to the tangential direction, the coupling elements will be driven apart and be released from each other by applying a torque either in a clockwise direction or a counter-clockwise direction about the central axis. If a user wants to release the coupling components, which may be done for the purpose of a cleaning action, for example, he/she may apply a torque on purpose to cause to drive away the first and second coupling elements from each other and to cause a relative axial movement of the coupling elements. Due to the axial movement the user will have a tactile and visual feedback that the torque is sufficient for releasing the coupling elements.

SUMMARY OF THE INVENTION

It is an object of the invention to provide a coupling assembly which is suitable for use in personal care appliance, especially at an interface between a body and a head of the personal care appliance for releasably coupling the body and the head. In particular, it is an object of the invention to provide an improvement to the design of a coupling assembly of the type as known from WO 2014/191265 A1, i.e. a coupling assembly of the type in which coupled coupling elements can be driven away from each other in an axial direction extending parallel to a central axis of the coupling assembly by rotating the coupling elements with respect to each other in a rotational direction about the central axis, on the basis of a sliding movement of an inclined surface of one of the coupling elements over an inclined surface of another of the coupling elements, at one or more positions in the coupling assembly.

In view of the foregoing, the invention provides a coupling assembly configured to be used in a personal care appliance at an interface between a body and a head of the personal care appliance for releasably coupling the body and the head, wherein the coupling assembly comprises a coupling element and a retaining member having a receiving space which is configured to receive and accommodate the coupling element, wherein one of the coupling element and the retaining member comprises at least one cam element projecting in a direction of a central axis of the coupling assembly and another of the coupling element and the retaining member comprises at least one notch which is configured to receive and accommodate the at least one cam element so as to constitute at least one coupling combination, wherein, in a peripheral direction about the central axis, the at least one cam element has two oppositely sloped surfaces converging in a direction from a base to a furthest projecting end of the at least one cam element, and the at least one notch has two oppositely sloped surfaces converging in a direction from an open side to a deepest side of the at least one notch so as to allow release of a coupled position of the coupling assembly on the basis of a rotation of the coupling element and the retaining member with respect to each other about the central axis, and wherein, in the at least one coupling combination, the cam element and the notch are configured to leave space between them at the position of a furthest projecting non-contact portion of the cam element and an associated deepest non-contact portion of the notch and to only contact each other at two sides through their sloped surfaces at the position of a less projecting contact portion of the cam element and an associated less deep contact portion of the notch in the coupled position of the coupling assembly.

It follows from the foregoing definition that the coupling assembly according to the invention, like the coupling assembly known from WO 2014/191265 A1, comprises two coupling elements which are configured to cooperate, wherein one of the coupling elements is simply denoted as coupling element, and wherein another of the coupling elements is denoted as retaining member having a receiving space which is configured to receive and accommodate the one coupling element. One of the coupling element and the retaining member comprises at least one cam element projecting in a direction of a central axis of the coupling assembly and another of the coupling element and the retaining member comprises at least one notch which is configured to receive and accommodate the at least one cam element so as to constitute at least one coupling combination. Further, in a peripheral direction about the central axis, the at least one cam element has two oppositely sloped surfaces converging in a direction from a base to a furthest projecting end of the at least one cam element. Likewise, the at least one notch has two oppositely sloped surfaces converging in a direction from an open side to a deepest side of the at least one notch. Thus, both the coupling element and the retaining member include inclined surfaces, on the basis of which release of a coupled position of the coupling assembly on the basis of a rotation of the coupling element and the retaining member with respect to each other about the central axis is enabled.

According to the invention, in the at least one coupling combination, the cam element and the notch are configured to leave space between them at the position of a furthest projecting non-contact portion of the cam element and an associated deepest non-contact portion of the notch and to only contact each other at two sides through their sloped surfaces at the position of a less projecting contact portion of the cam element and an associated less deep contact portion of the notch in the coupled position of the coupling assembly. For example, in a coupling assembly comprising two coupling combinations of a cam element and a notch, contact between the cam elements and the notches of the coupling assembly is to be established only at the position of four areas, namely two areas per coupling combination.

As an advantageous result of not having contact between the cam element and the notch of a coupling combination along the entire area of their sloped surfaces but along a limited area of their sloped surfaces instead, coupling stability is improved, at least in the peripheral direction about the central axis. The fact is that the contact portions of the cam element and the notch can be well defined and easily tuned. Especially when the coupling assembly is designed to press the cam element and the notch towards each other in the direction of the central axis in the coupled position, under the influence of form closure measures and/or force closure measures, total fixation can be realized. It is to be noted that in the configuration as defined, the area of contact between the cam element and the notch is at the position of the largest dimensions of the cam element and the notch as seen in the peripheral direction about the central axis, which adds to stability of the coupling assembly in the coupled position.

In the context of the invention, the sloped surfaces of the cam element and the notch of a coupling combination may be designed in any suitable way so as to realize the above-mentioned result that space is left between the cam element and the notch at the position of their non-contact portions and that the cam element and the notch only contact each other at two sides through the sloped surfaces at the position of their contact portions in the coupled position of the coupling assembly. For example, it may be practical if each of the sloped surfaces of at least one of the cam element and the notch comprises at least two portions which are different as far as their sloping orientation is concerned. Also, it may be practical if at least in the non-contact portion of the cam element and the associated non-contact portion of the notch, the two oppositely sloped surfaces of the cam element converge more strongly than the two oppositely sloped surfaces of the notch.

Besides the above-mentioned measures relating to design aspects of the cam element and the notch in the peripheral direction about the central axis, it is also possible to have measures relating to design aspects of the cam element and the notch in the direction of the central axis. For example, it may be practical if in the at least one coupling combination, a dimension of the non-contact portion of the cam element in the direction of the central axis is smaller than a dimension of the associated non-contact portion of the notch in the direction of the central axis.

As mentioned in the foregoing, having contact between the cam element and the notch of the at least one coupling combination only along a limited area of their sloped surfaces is an advantageous aspect of the invention, which involves improvement of coupling stability. In view thereof, in a practical embodiment of the coupling assembly according to the invention, it may be so that in the direction of the central axis, a dimension of the contact portion of the cam element is smaller than a dimension of the non-contact portion of the cam element, and a dimension of the contact portion of the notch is smaller than a dimension of the non-contact portion of the notch.

Further, as mentioned in the foregoing, it may be advantageous if the coupling assembly according to the invention is designed to press the cam element and the notch towards each other in the direction of the central axis in the coupled position, under the influence of form closure measures and/or force closure measures. In view thereof, the coupling assembly may comprise a biasing mechanism which is configured to exert a force acting in the direction of the central axis to bias the coupling element inward in the retaining member.

According to a practical option, the coupling assembly comprises a snap connection mechanism which is configured to provide a snap connection at an interface of the coupling element and the retaining member in the coupled position of the coupling assembly, and which includes at least one set of a snap connection area and a resilient snap connection element which is configured to engage with the snap connection area. For example, as known per se from WO 2014/191265 A1, it may be so that the retaining member comprises a spring element which is at least partially located in the receiving space, wherein it may be practical if the spring element is generally U-shaped, including a basis and two legs extending from the basis, and if the spring element is arranged such that at least a portion of each of the legs is located in the receiving space. With reference to WO 2014/191265 A1, it is noted that it may further be so that the coupling element is provided with at least two indentations which are configured to receive and accommodate at least two portions of the spring element so as to allow the spring element to engage with the coupling element in the coupled position of the coupling assembly. A robust snap connection is obtained when such indentations are shaped like a groove having a concavely curved surface in cross-section, for example.

Assuming that the coupling assembly according to the invention comprises two coupling combinations of a cam element and a notch, it is not necessary for those coupling combinations to be dimensioned in the same way. Thus, assuming that the coupling assembly includes two cam elements and two notches, it may be so that in the peripheral direction about the central axis, one of the cam elements and one of the notches are small relative to another of the cam elements and another of the notches, respectively, so as to realize a coupling combination of a cam element and a notch of relatively small size and a coupling combination of a cam element and a notch of relatively large size in the coupling assembly. Having coupling combinations of different size helps in improving coupling stability in a plane to which the central axis is perpendicular. In this respect, it may be advantageous to have a configuration in which the two cam elements and the two notches, respectively, are diametrically opposed to each other about the central axis, as in such a case, especially when the coupling assembly is designed to press the cam element and the notch towards each other in the direction of the central axis in the coupled position, a resulting force towards the coupling combination of relatively small size may be created in the plane to which the central axis is perpendicular. Further, on the basis of having coupling combinations of different size, a user acting to establish the coupled position of the coupling assembly is guided to do so in a predefined way, wherein the relatively small cam element needs to be associated with the relatively small notch, and wherein the relatively large cam element needs to be associated with the relatively large notch.

The invention further relates to a personal care appliance comprising a body, a head and a coupling assembly having one or more of the features defined and elucidated in the foregoing, wherein the coupling assembly is located at an interface between the body and the head for releasably coupling the body and the head. In such a personal care appliance, it may particularly be so that the coupling element of the coupling assembly is included in the head, wherein, in the coupled position of the coupling assembly, the head is solely supported by the coupling element, so that there is no need for any additional supporting mechanism. One practical example of such a personal care appliance is a shaving appliance in which the head is configured to support at least two rotary shaving units. In the case that the coupling element is included in the head, a practical and compact configuration may be obtained if a drive shaft which is configured to drive the at least two rotary shaving units extends through the coupling element.

The above-described and other aspects of the invention will be apparent from and elucidated with reference to the following detailed description of a shaving appliance comprising a coupling assembly which is of the type including two sets/coupling combinations of a cam element and a notch which is configured to receive and accommodate the cam element. It is noted that the shaving appliance is just one out of numerous practical examples of personal care appliances according to the invention, and that likewise, the coupling assembly is just one out of numerous practical examples of coupling assemblies according to the invention.

BRIEF DESCRIPTION OF THE DRAWINGS

The invention will now be explained in greater detail with reference to the figures, in which equal or similar parts are indicated by the same reference signs, and in which.

DETAILED DESCRIPTION OF THE EMBODIMENTS

Figure 1:
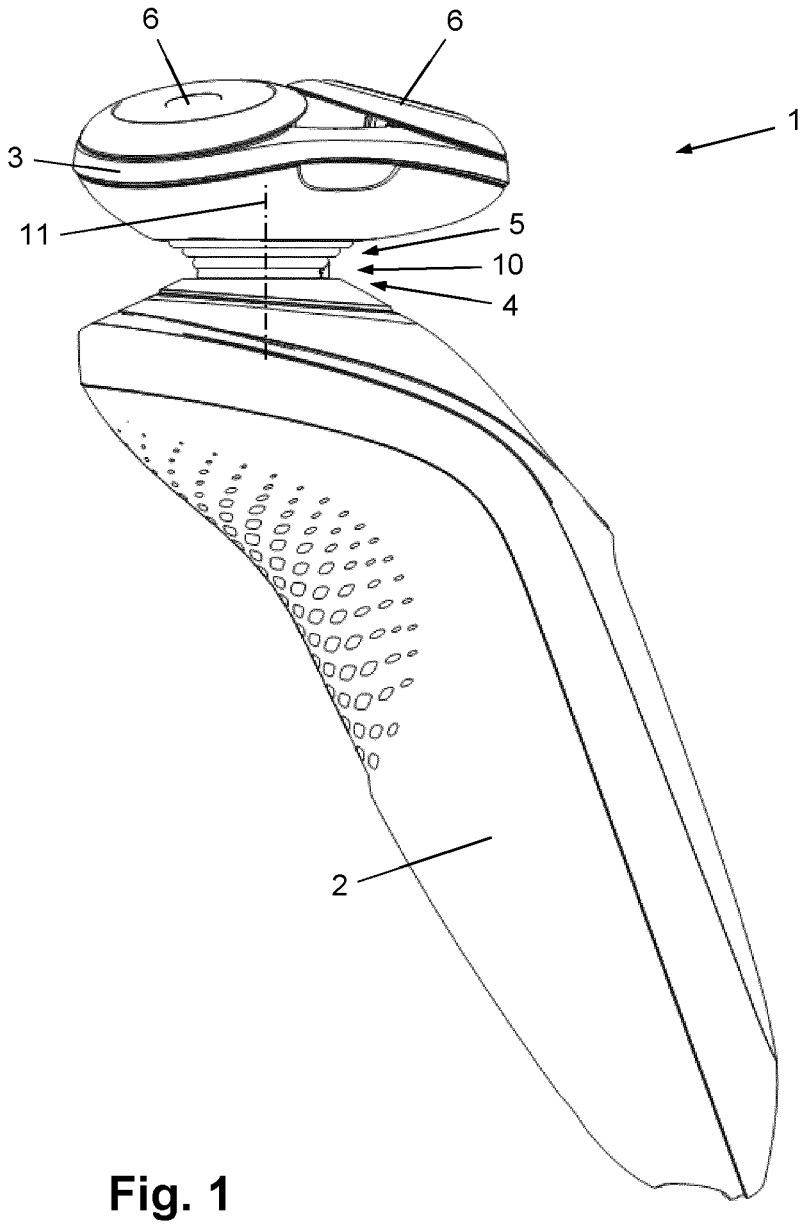
FIG. 1 diagrammatically shows a side view of a shaving appliance according to an embodiment of the invention including a body, a head and a coupling assembly at an interface between the body and the head.

FIG. 1 shows a shaving appliance 1, which is a practical example of a personal care appliance according to the invention. The shaving appliance 1 comprises a body 2 which is intended to be taken hold of by a user of the shaving appliance 1, and a head 3 which is intended to be pressed against a skin area to be subjected to a shaving action. In FIG. 1, the shaving appliance 1 is shown in a normal orientation, and in the following, indications such as top and bottom are to be understood in the context of the normal orientation.

At a top side, the body 2 includes a body component 4. At a bottom side, the head 3 includes a head component 5, and at a top side, the head 3 includes a number of rotary shaving units 6, the number being three in the shown example. The shaving appliance 1 further comprises a coupling assembly 10 which is located at an interface between the body 2 and the head 3 for releasably coupling the body 2 and the head 3. A central axis of the coupling assembly 10 is shown as a dash-dot line 11 in FIG. 1. On the basis of the presence of the coupling assembly 10, a user is enabled to remove the head 3 from the body 2, which may be done for various reasons such as a need to service and/or clean the head 3, a need to replace the head 3 by a head of another type, etc.

Figure 2:
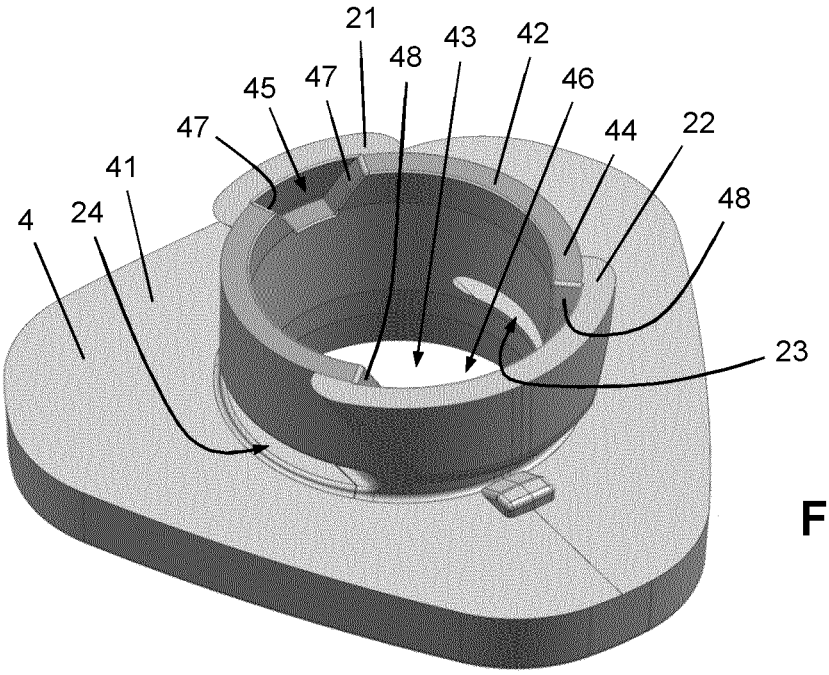
FIG. 2 diagrammatically shows a perspective view of a body component of the shaving appliance incorporating a retaining member of the coupling assembly.
Figure 3:
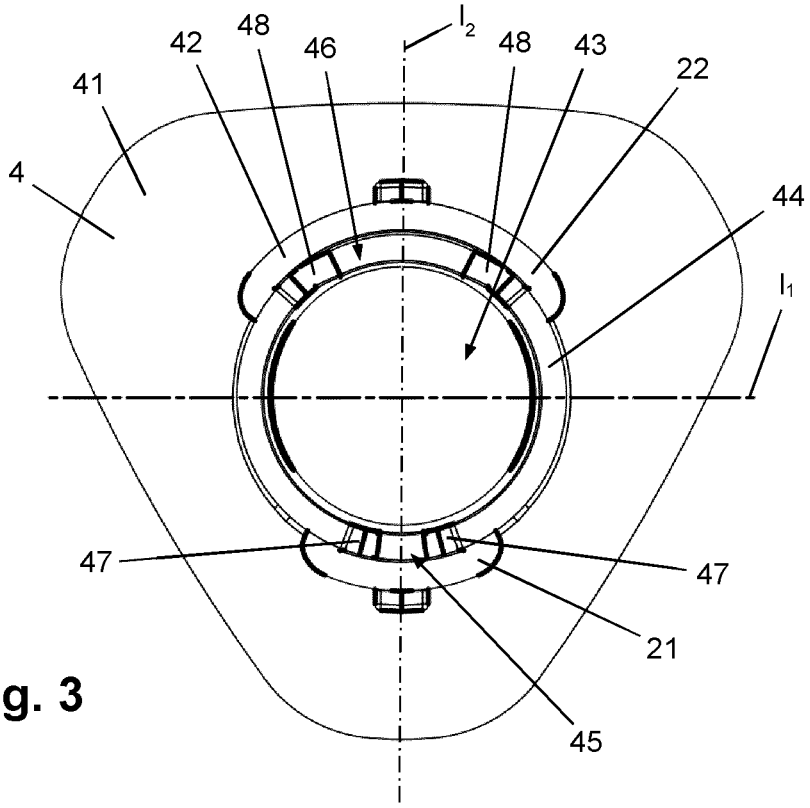
FIG. 3 diagrammatically shows a top view of the body component.
Figure 4:
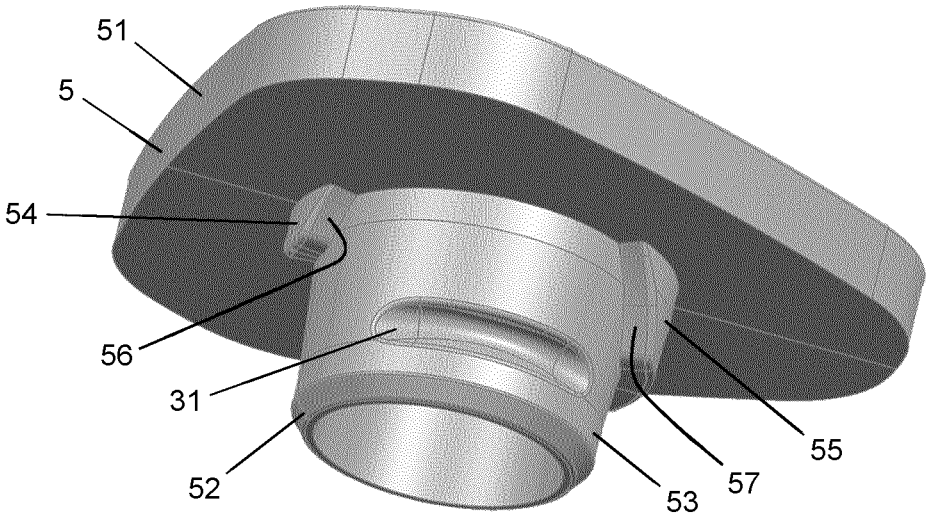
FIG. 4 diagrammatically shows a perspective view of a head component of the shaving appliance incorporating a coupling element of the coupling assembly.
Figure 5:
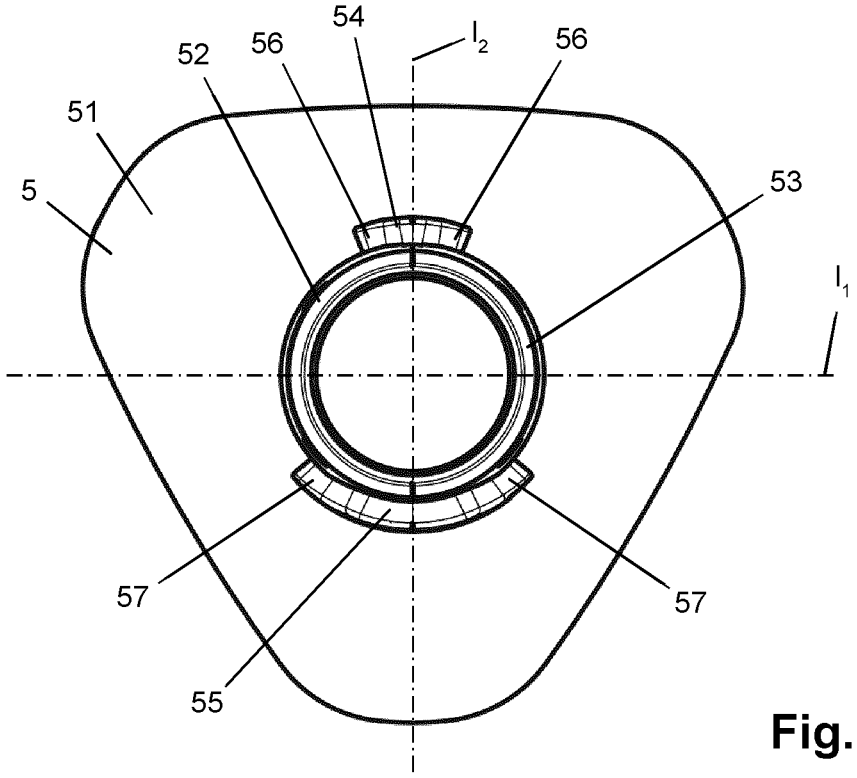
FIG. 5 diagrammatically shows a bottom view of the head component.

The body component 4 is separately shown in FIGS. 2 and 3, whereas the head component 5 is separately shown in FIGS. 4 and 5. The head component 5 includes a head plate 51 and a coupling element 52 extending downwardly from the head plate 51, whereas the body component 4 includes a body plate 41 and a retaining member 42 extending upwardly from the body plate 41, the retaining member 42 having a receiving space 43 which is configured to receive and accommodate the coupling element 52. Both the coupling element 52 and the retaining member 42 are part of the coupling assembly 10. Hence, in the shown example, one part of the coupling assembly 10 is incorporated in the body 2 through the body component 4, and another part of the coupling assembly 10 is incorporated in the head 3 through the head component 5.

The coupling element 52 comprises a hollow cylinder 53 having substantially circular inner and outer peripheries. Among other things, the hollow cylinder 53 is suitable for allowing a drive shaft (not shown) which is configured to drive the rotary shaving units 6 to extend through the coupling element 52. At the outer periphery of the hollow cylinder 53, two cam elements 54, 55 of different size are arranged, namely a relatively small cam element 54 and a relatively large cam element 55. The cam elements 54, 55 are positioned so as to project downwardly from the head plate 51 and have a certain thickness on the outer periphery of the hollow cylinder 53, while extending in both a direction of the central axis 11 of the coupling assembly 10, which coincides with the central axis of the hollow cylinder 53, and a peripheral direction about the central axis 11. In the following, for the sake of clarity, a dimension of the cam element 54, 55 in the direction of the central axis 11 will be referred to as length of the cam element 54, 55, whereas a dimension of the cam element 54, 55 in the peripheral direction about the central axis 11 will be referred to as peripheral width of the cam element 54, 55. Advantageously, the size difference between the cam elements 54, 55 involves both a difference in length and a difference in peripheral width.

In the shown example, the cam elements 54, 55 are diametrically opposed to each other about the central axis 11. In the peripheral direction about the central axis 11, each of the cam elements 54, 55 has two oppositely sloped surfaces 56, 57 converging in a direction from a base to a furthest projecting end of the cam element 54, 55. Hence, the cam elements 54, 55 have a largest peripheral width at a position near the head plate 51 and a smallest peripheral width at a most downward position.

The retaining member 42 comprises a hollow cylinder 44 having an inner diameter which is chosen such that the hollow cylinder 44 of the retaining member 42 is capable of encompassing the hollow cylinder 53 of the coupling element 52. In a top end of the hollow cylinder 44, two notches 45, 46 of different size are arranged, namely a relatively small notch 45 and a relatively large notch 46. The notches 45, 46 have a dimension in both a direction of the central axis 11 of the coupling assembly 10, which coincides with the central axis of the hollow cylinder 44, and a peripheral direction about the central axis 11. In the following, for the sake of clarity, the dimension of the notch 45, 46 in the direction of the central axis 11 will be referred to as depth of the notch 45, 46, whereas the dimension of the notch 45, 46 in the peripheral direction about the central axis 11 will be referred to as peripheral width of the notch 45, 46. Advantageously, the size difference between the notches 45, 46 involves both a difference in depth and a difference in peripheral width. In the shown example, the notches 45, 46 are diametrically opposed to each other about the central axis 11. In the peripheral direction about the central axis 11, each of the notches 45, 46 is delimited by two oppositely sloped surfaces 47, 48 converging in a direction from an open side to a deepest side of the notch 45, 46. Hence, the notches 45, 46 have a largest peripheral width at a most upward position and a smallest peripheral width at a most downward position.

At the position of the notches 45, 46, the retaining member 42 is equipped with curved strips 21, 22 which are arranged so as to cover portions of the hollow cylinder 44 including the notches 45, 46, like hollow cylinder parts having an inner diameter which is about the same as an outer diameter of the hollow cylinder 44. In this configuration, the notches 45, 46 are delimited in an outer radial direction. The curved strips 21, 22 or similar portions of the retaining member 42 may be integrated with the other portions of the retaining member 42. In particular, the body component 4 may be provided as a single integral entirety, and the same is applicable to the head component 5.

Figure 6:
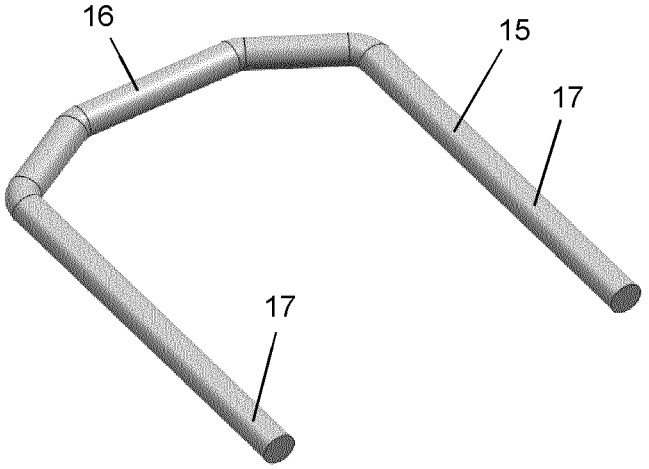
FIG. 6 diagrammatically shows a perspective view of a spring element of the coupling assembly.

Besides the coupling element 52 and the retaining member 42, the coupling assembly 10 comprises a spring element 15. The spring element 15 is separately shown in FIG. 6. In the shown example, the spring element 15 is generally U-shaped, including a basis 16 and two legs 17 extending from the basis 16. The spring element 15 is intended to be arranged on the body component 4 at a position on the body plate 41. The hollow cylinder 44 is provided with elongated openings 23, 24 extending at a lowest level of the hollow cylinder 44 in portions of the hollow cylinder 44 which are diametrically opposed to each other about the central axis 11 and which are left uncovered by the curved strips 21, 22. Further, the curved strips 21, 22 are arranged such that space is present between a bottom side of the curved strips 21, 22 and the body plate 41. In the assembled state of the body component 4 and the spring element 15, the base 16 of the spring element 15 is located in the space between the curved strip 21 delimiting the relatively small notch 45 and the body plate 41, and the legs 17 of the spring element 15 partially extend through the receiving space 43 at the position of the elongated openings 23, 24.

Figure 7:
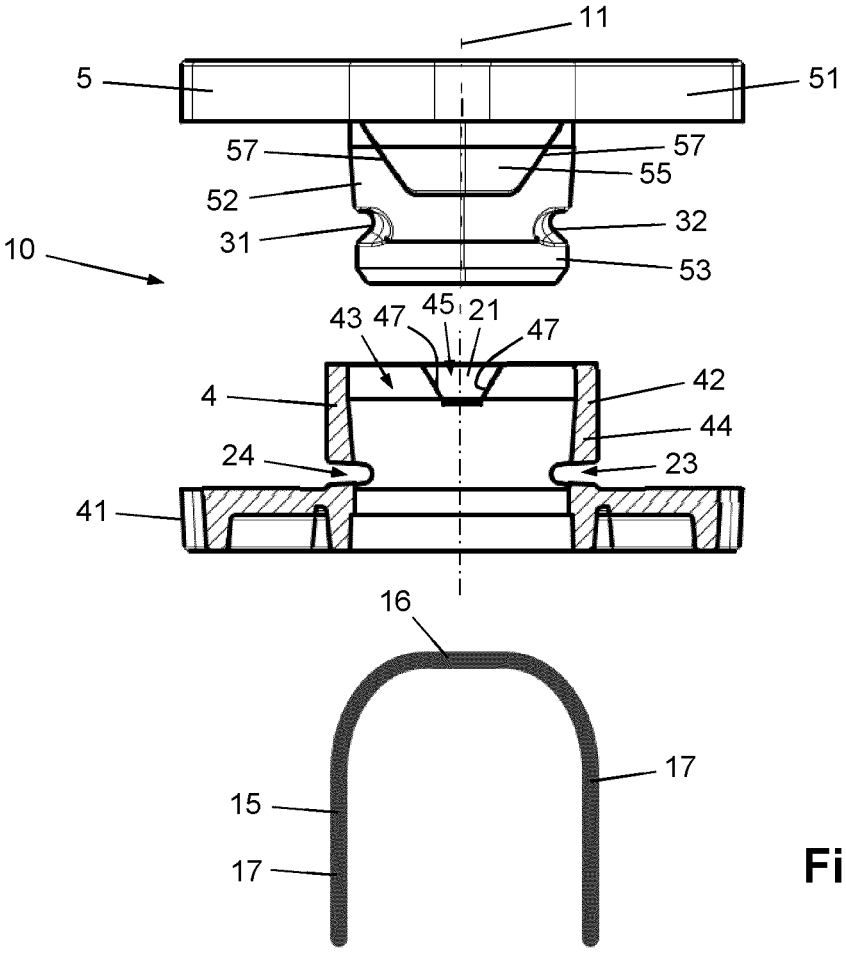
FIG. 7 diagrammatically shows an exploded view of the configuration including the body component, the head component and the spring element, wherein the body component is depicted in longitudinal section.

The spring element 15 has a function in securing the coupled position of the coupling assembly 10. The coupling element 52 is provided with two elongated indentations 31, 32 at appropriate positions on the hollow cylinder 53. In the shown example, the elongated indentations 31, 32 are shaped like a groove having a concavely curved surface in cross-section, as can be seen in FIG. 7. In the coupled position of the coupling assembly 10, the elongated indentations 31, 32 of the coupling element 52 are at the position where the legs 17 of the spring element 15 partially extend through the receiving space 43 of the retaining member 42. Thus, it is achieved that portions of the legs 17 of the spring element 15 are accommodated in the elongated indentations 31, 32 of the coupling element 52, whereby the spring element 15 is made to act on the coupling element 52 such that the coupling element 52 is subjected to a pulling force acting in a downward direction, i.e. a direction towards the body 2.

When the body 2 and the head 3 are separated from each other and a user desires to establish a coupling between them, the user moves the body 2 and the head 3 towards each other in such a way that the coupling element 52 is eventually inserted in the receiving space 43 of the retaining member 42. In the process, the user is supposed to make sure that the relatively small cam element 54 and the relatively small notch 45 are at least roughly at positions for engaging with each other, and also that the relatively large cam element 55 and the relatively large notch 46 are at least roughly at positions for engaging with each other when the body 2 and the head 3 are moved towards each other. Due to the fact that the cam elements 54, 55 have sloped surfaces 56, 57 and the notches 45, 46 have sloped surfaces 47, 48 as well, there is no need for a user to exactly align the cam elements 54, 55 and the notches 45, 46 in the peripheral direction about the central axis 11. In the case of a deviation in the peripheral direction about the central axis, the appropriate sloped surfaces 47, 48; 56, 57 slide along each other as long as the body 2 and the head 3 are moved towards each other and thereby automatically realize a final configuration in which the cam elements 54, 55 are exactly in place in the notches 45, 46. For example, the design of the coupling element 52 and the retaining member 42, particularly the shape and the dimensions of the cam elements 54, 55 and the notches 45, 46 may be chosen such that a deviation of as large as 200 in the peripheral direction about the central axis 11 from the aligned position is allowed. The process of establishing the coupling ends when the cam elements 54, 55 are exactly in place in the notches 45, 46, as mentioned, and when the legs 17 of the spring element 15 have snapped in the indentations 31, 32 of the coupling element 52.

On the basis of the fact that two sets/coupling combinations of cam elements 54, 55 and notches 45, 46 of different size are present in the coupling assembly 10, a possibility of wrong placement of the body 2 and the head 3 with respect to each other is eliminated.

When at a later stage the user desires to decouple the head 3 from the body 2, he/she is supposed to do so by exerting forces on the head 3 and the body 2 aimed at pulling the head 3 and the body 2 apart. In the process, the user is allowed to twist the head 3 and the body 2 with respect to each other, which actually helps in decoupling the coupling element 52 from the retaining member 42.

Figure 8:
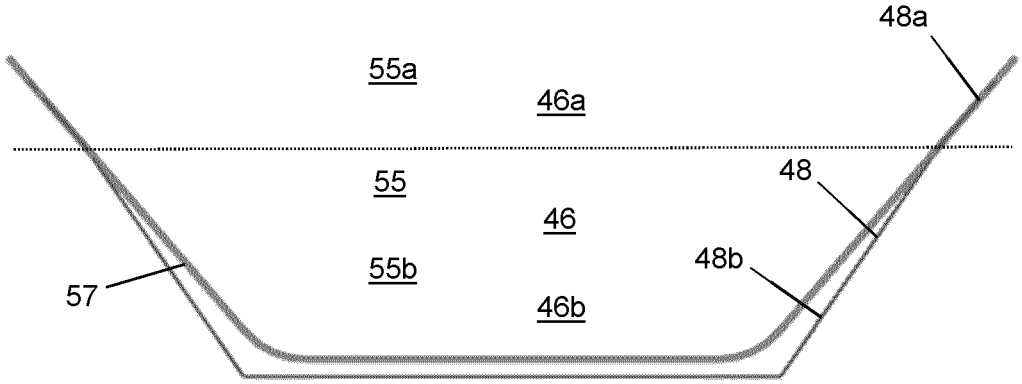
FIG. 8 illustrates the nature of contact between the coupling element and the retaining member at the position of a cam element of the coupling element and a notch of the retaining member in the coupled position of the coupling assembly.

With reference to FIG. 8, further details of the design of the cam elements 54, 55 and the notches 45, 46 are explained. FIG. 8 relates to the coupled position of the coupling assembly 10 and shows outlines of the relatively large cam element 55 and the relatively large notch 46, which does not alter the fact that a similar figure is applicable to a coupling combination of the relatively small cam element 54 and the relatively small notch 45. FIG. 8 particularly illustrates the fact that in the coupling position of the coupling assembly 10, the cam element 55 and the notch 46 contact each other only at the position of their sloped surfaces 48; 57, and that the contact is not along the entire area of the sloped surfaces 48; 57 but along a limited area of the sloped surfaces 48; 57 instead. Apart from that, space is present between the cam element 55 and the notch 46. Hence, a contact portion 46*a*; 55*a* and a non-contact portion 46*b*; 55*b* are distinguished in both the notch 46 and the cam element 55. A virtual line separating the contact portion 46*a*; 55*a* and the non-contact portion 46*b*; 55*b* of the notch 46 and the cam element 55, respectively, is shown in FIG. 8 as a dotted line.

In the shown example, a length of the contact portion 55*a* of the cam element 55 is smaller than a length of the non-contact portion 55*b* of the cam element 55. Likewise, a length of the contact portion 46*a* of the notch 46 is smaller than a length of the non-contact portion 46*b* of the notch 46. Further, the length of the non-contact portion 55*b* of the cam element 55 is smaller than the length of the non-contact portion 46*b* of the notch 46.

The contact portion 55*a* of the cam element 55 is located at a base side of the cam element 55 and may therefore be denoted as a less projecting portion of the cam element 55, whereas the non-contact portion 55*b* of the cam element 55 is a more projecting portion of the cam element 55. Likewise, the non-contact portion 46*b* of the notch 46 is a deepest portion of the notch 46, whereas the contact portion 46*a* of the notch 46 is a less deep portion of the notch 46. In the shown example, it is achieved that in the coupling position of the coupling assembly 10, the sloped surfaces 48; 57 of the notch 46 and the cam element 55, respectively, only contact each other through limited areas on the basis of a multi-angled design of the sloped surfaces 48 of the notch 46, according to which each of the sloped surfaces 48 of the notch 46 comprises two portions 48*a*, 48*b* of different sloping orientation. The sloping orientation of the sloped surfaces 48; 57 of the notch 46 and the cam element 55, respectively, is practically the same at the position of the contact portion 46*a*, 55*a* of the notch 46 and the cam element 55, respectively, whereas the sloping orientation of the sloped surfaces 48; 57 of the notch 46 and the cam element 55, respectively, is different at the position of the non-contact portion 46*b*, 55*b* of the notch 46 and the cam element 55, respectively. In other words, in the contact portion 46*a*, 55*a* of the notch 46 and the cam element 55, respectively, the sloped surfaces 48; 57 of the notch 46 and the cam element 55, respectively, converge to a similar extent, whereas in the non-contact portion 46*b*, 55*b* of the notch 46 and the cam element 55, respectively, the sloped surfaces 57 of the cam element 55 converge more strongly than the sloped surfaces 48 of the notch 46.

On the basis of the above-described configuration of the coupling assembly 10, a number of advantages are obtained, including advantages of improvement of coupling stability. In particular, on the basis of the particular design of the notches 45, 46 and the cam elements 54, 55 with the contact portion 46*a* and the non-contact portion 55*a*, not even the slightest mutual movement in the peripheral direction about the central axis 11 is allowed. This is all the more so in a situation in which a force acting in the direction of the central axis 11 to pull the coupling element 52 inward in the retaining member 42 is applied, for example through the establishment of a snap connection between the coupling element 52 and the retaining member 42, as described in the foregoing. Also, coupling stability in a plane to which the central axis 11 is perpendicular is improved, namely a direction along a left-right line $\mathbf{1}_1$ in the plane which is perpendicular to a direction along a back-forth line $\mathbf{1}_2$ in the plane intersecting the notches 45, 46 and the cam elements 54, 55 at a central position, wherein it is noted that both the left-right line $\mathbf{1}_1$ and the back-forth line $\mathbf{1}_2$ can be seen in FIGS. 3 and 5.

When it comes to coupling stability about an axis extending in the direction of the back-forth line $\mathbf{1}_2$, it is noted that each set of sloped surfaces 47, 48 of the notches 45, 46 creates a pivot point defined by the crossing of normal forces acting on the sloped surfaces 47, 48 in the contact portion 46*a* of the notches 45, 46. The two pivot points of the two notches 45, 46 define a pivot axis extending in the direction of the back-forth line $\mathbf{1}_2$. The head component 5 can translate along and rotate about this pivot axis with respect to the body component 4. In order to have optimal stability about the pivot axis, the size of the notches 45, 46 comes into play. The larger the notch 45, 46, the further away is the pivot point mentioned earlier, i.e. the pivot point which is defined by the crossing of the normal forces acting on the sloped surfaces 47, 48 in the contact portion 46*a* of the notches 45, 46. A large distance to the pivot axis results in a higher momentum of the friction forces involved in the contact about the pivot axis. Thus, especially in view of the fact that a relatively large notch 46 is included in the coupling assembly 10, it is achieved that the head component 5 can be kept in a stable position with respect to the body component 4.

Translation of the head component 5 along the pivot axis with respect to the body component 4 is eliminated on the basis of the fact that two notches 45, 46 of different peripheral width are applied in the coupling assembly 10. Due to the difference of the peripheral width, an asymmetric distribution of forces in the direction of the back-forth line $\mathbf{1}_2$ is obtained, such that a resulting force acts in a direction towards the relatively small notch 45.

Concluding, on the basis of the various features of the coupling assembly 10, it is achieved that a coupling between the body component 4 and the head component 5 can be obtained which is firm and secure on the one hand, with maximum coupling stability, and which can easily be released on the other hand. Further, the coupling assembly 10 is robust for misuse, as a user is helped in correctly positioning the body component 4 and the head component 5 with respect to each other on the basis of the differently sized sets/coupling combinations of cam elements 54, 55 and notches 45, 46, and the user is allowed to not only move the body component 4 and the head component 5 in an axial direction, but also to twist the body component 4 and the head component 5 with respect to each other.

It will be clear to a person skilled in the art that the scope of the invention is not limited to the examples discussed in the foregoing, but that several amendments and modifications thereof are possible without deviating from the scope of the invention as defined in the attached claims. It is intended that the invention be construed as including all such amendments and modifications insofar they come within the scope of the claims or the equivalents thereof. While the invention has been illustrated and described in detail in the figures and the description, such illustration and description are to be considered illustrative or exemplary only, and not restrictive. The invention is not limited to the disclosed embodiments. The drawings are schematic, wherein details which are not required for understanding the invention may have been omitted, and not necessarily to scale.

Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. Any reference signs in the claims should not be construed as limiting the scope of the invention.

Elements and aspects discussed for or in relation with a particular embodiment may be suitably combined with elements and aspects of other embodiments, unless explicitly stated otherwise. Thus, the mere fact that certain measures are recited in mutually different dependent claims does not indicate that a combination of these measures cannot be used to advantage.

The terms "comprise" and "include" as used in this text will be understood by a person skilled in the art as covering the term "consist of". Hence, the term "comprise" or "include" may in respect of an embodiment mean "consist of", but may in another embodiment mean "contain/have/be equipped with at least the defined species and optionally one or more other species".

In the shown example, the retaining member 42 of the coupling assembly 10 is integrated in the body component 4, whereas the coupling element 52 of the coupling assembly 10 is integrated in the head component 5. It will be understood that this is not essential and that it can be the other way around, to mention one of a number of alternatives covered by the invention which can be readily conceived by a person skilled in the art.

Notable aspects of the invention can be summarizes as follows. For releasably coupling a body 2 and a head 3 of a personal care appliance 1, a coupling assembly 10 is provided which comprises a coupling element 52 and a retaining member 42 having a receiving space 43 which is configured to receive and accommodate the coupling element 52. One of the coupling element 52 and the retaining member 42 comprises at least one cam element 54, 55 and another of the coupling element 52 and the retaining member 42 comprises at least one notch 45, 46 which is configured to receive and accommodate the at least one cam element 54, 55 so as to constitute at least one coupling combination. Both the at least one cam element 54, 55 and the at least one notch 45, 46 have two oppositely sloped surfaces 47, 48; 56, 57. In the at least one coupling combination, in a coupled position of the coupling assembly 10, the cam element 54, 55 and the notch 45, 46 only contact each other at two sides through their sloped surfaces 47, 48;

56, 57 at the position of a contact portion 55*a* at a base of the cam element 54, 55 and an associated contact portion 46*a* of the notch 45, 46 at an open side of the notch 45, 46.

The invention claimed is:

1. A coupling assembly configured to be used in a personal care appliance at an interface between a body and a head of the personal care appliance for releasably coupling the body and the head, the coupling assembly comprising:

a coupling element; and a retaining member having a receiving space configured to receive and retain the coupling element, wherein one of the coupling element and the retaining member comprises at least one cam element projecting in a direction of a central axis of the coupling assembly and another of the coupling element and the retaining member comprises at least one notch configured to receive and accommodate the at least one cam element when the coupling element is received in the receive space so as to constitute at least one coupling combination, wherein, in a direction encircling the central axis, the at least one cam element has two oppositely sloped surfaces converging in a direction from a base to a furthest projecting end of the at least one cam element, and the at least one notch has two oppositely sloped surfaces converging in a direction from an open side to a deepest side of the at least one notch, and wherein, in the at least one coupling combination, the at least one cam element and the at least one notch are configured to be in contact between a contact portion of the at least one cam element and an associated contact portion of the at least one notch, and to leave a space between a non-contact portion of the at least one cam element and an associated non-contact portion of the at least one notch, wherein the non-contact portions of the at least one cam element and the at least one notch begin where the two oppositely sloped surfaces of the cam element respectively diverge from the two oppositely sloped surfaces of the at least one notch at a position between the base and the furthest projecting end of the least one cam element.

2. The coupling assembly according to claim 1, wherein, in the at least one coupling combination, each of the oppositely sloped surfaces of the at least one notch comprises at least two portions having different sloping orientations to provide the space between the non-contact portion of the at least one cam element and the non-contact portion of the at least one notch.

3. The coupling assembly according to claim 1, wherein, in the at least one coupling combination, a dimension of the non-contact portion of the cam element in the direction of the central axis is smaller than a dimension of the associated non-contact portion of the notch in the direction of the central axis.

4. The coupling assembly according to claim 1, wherein, in the direction of the central axis a dimension of the contact portion of the cam element is smaller than a dimension of the non-contact portion of the cam element and a dimension of the contact portion of the notch is smaller than a dimension of the non-contact portion of the notch.

5. The coupling assembly according to claim 1, further comprising a spring element configured to exert a force acting in the direction of the central axis to bias the coupling element inward in the retaining member.

6. The coupling assembly according to claim 5, wherein the spring element is at least partially located in the receiving space.

7. The coupling assembly according to claim 6, wherein the spring element is generally U-shaped, and includes a basis and two legs extending from the basis, wherein at least a portion of each leg is located in the receiving space.

8. The coupling assembly according to claim 7, wherein the coupling element defines two indentations configured to receive the at least a portion of each leg of the spring element so as to allow the spring element to engage with the coupling element in a coupled position of the coupling assembly.

9. The coupling assembly according to claim 1, comprising a snap connection mechanism configured to provide a snap connection at an interface of the coupling element and the retaining member in a coupled position of the coupling assembly, wherein the snap connection mechanism includes at least one set of a snap connection area and a resilient snap connection element configured to engage with the snap connection area.

10. The coupling assembly according to claim 1, wherein the at least one cam element comprises a first cam element and a second cam element, and the at least one notch comprises a first notch and a second notch, wherein in the direction encircling the central axis, the first cam element and the first notch are small relative to the second cam element and the second notch so as to realize a first coupling combination of first cam element and the first notch of relatively small size and a second coupling combination of the second cam element and the second notch of relatively large size in the coupling assembly.

11. The coupling assembly according to claim 10, wherein the first and second cam elements and the first and second notches, respectively, are diametrically opposed to each other about the central axis.

12. A personal care appliance comprising:

a body;

a head; and the coupling assembly according to claim 1, wherein the coupling assembly is located at an interface between the body and the head for releasably coupling the body and the head.

13. The personal care appliance according to claim 12, wherein the coupling element of the coupling assembly is included in the head and wherein, in a coupled position of the coupling assembly, the head is supported by the coupling element.

14. The personal care appliance according to claim 12, wherein the head is configured to support at least two rotary shaving units.

15. The coupling assembly according to claim 1, wherein the space includes separation of the furthest projecting end of the at least one cam element from the deepest side of the at least one notch.

16. The coupling assembly according to claim 1, wherein, in the at least one coupling combination, each of the oppositely sloped surfaces of the at least one cam element comprises at least two portions having different sloping orientations to provide the space between the non-contact portion of the at least one cam element and the non-contact portion of the at least one notch.

17. A coupling assembly configured to be used in a personal care appliance at an interface between a body and a head of the personal care appliance for releasably coupling the body and the head, the coupling assembly comprising:

a coupling element; and a retaining member having a receiving space configured to receive and retain the coupling element, wherein one of the coupling element and the retaining member comprises at least one cam element projecting in a direction of a central axis of the coupling assembly and another of the coupling element and the retaining member comprising at least one notch which is configured to receive and accommodate the at least one cam element when the coupling element is received in the receive space so as to constitute at least one coupling combination, wherein, in a direction encircling the central axis the at least one cam element has two oppositely sloped surfaces converging in a direction from a base to a furthest projecting end of the at least one cam element, and the at least one notch has two oppositely sloped surfaces converging in a direction from an open side to a deepest side of the at least one notch so as to allow release of a coupled position of the coupling assembly on the basis of a rotation of the coupling element and the retaining member with respect to each other about the central axis, wherein, in the at least one coupling combination, a space is provided between the at least one cam element and the at least one notch at a position of a furthest projecting non-contact portion of the at least one cam element and an associated deepest non-contact portion of the at least one notch, such that the at least one cam element and the at least one notch only contact each other at two sides through respective sloped surfaces at a position of a less projecting contact portion of the at least one cam element and an associated less deep contact portion of the at least one notch in the coupled position of the coupling assembly, and wherein, in the at least one coupling combination, the two oppositely sloped surfaces of the at least one cam element in the non-contact portion of the at least one cam element converge at a steeper angle than the two oppositely sloped surfaces of the at least one notch in the non-contact portion of the at least one notch.

18. A coupling assembly configured to releasably couple a body and a head of a personal care appliance, the coupling assembly comprising:

a coupling element incorporated in the head of the personal care appliance; and a retaining member incorporated in the body of the personal care appliance, and having a receiving space configured to receive and retain the coupling element, wherein the coupling element comprises a first cam element and a second cam element projecting in a direction of a central axis of the coupling assembly, wherein the retaining member comprises a first notch and a second notch configured to receive the first cam element and the second cam element, respectively, when the coupling element is received in the receive space to provide first and second coupling combinations, wherein, in a direction encircling the central axis, each of the first and second cam elements has two oppositely sloped surfaces converging in a direction from a base to a furthest projecting end of the first and second cam elements, wherein, in the direction encircling the central axis, each of the first and second notches has two oppositely sloped surfaces converging in a direction from an open side to a deepest side of the first and second notches, and wherein, in the first coupling combination, the first cam element and the first notch are configured to be in contact between a contact portion of the first cam element and an associated contact portion of the first notch, and to leave a space between a non-contact portion of the first cam element and an associated non-contact portion of the first notch, wherein the non-contact portions of the first cam element and the first notch begin where the two oppositely sloped surfaces of the first cam element respectively diverge from the two oppositely sloped surfaces of the first notch at a position between the base and the furthest projecting end of the first cam element.

19. The coupling assembly according to claim 18, wherein, in the second coupling combination, the second cam element and the second notch are configured to be in contact between a contact portion of the second cam element and an associated contact portion of the second notch, and to leave a space between a non-contact portion of the second cam element and an associated non-contact portion of the second notch, wherein the non-contact portions of the second cam element and the second notch begin where the two oppositely sloped surfaces of the second cam element respectively diverge from the two oppositely sloped surfaces of the second notch at a position between the base and the furthest projecting end of the second cam element.

20. The coupling assembly according to claim 19, wherein, in the first cam element and the first notch are larger than the second cam element and the second notch.

* * * * *